US008245600B2

(12) United States Patent
Beard

(10) Patent No.: US 8,245,600 B2
(45) Date of Patent: Aug. 21, 2012

(54) INSULATED CONTAINER WITH BOTTLE OPENER

(76) Inventor: Richard L. Beard, Portland, ME (US)

( * ) Notice: Subject to any disclaimer, the term of this patent is extended or adjusted under 35 U.S.C. 154(b) by 300 days.

(21) Appl. No.: 12/551,865

(22) Filed: Sep. 1, 2009

(65) Prior Publication Data

US 2011/0048061 A1 Mar. 3, 2011

(51) Int. Cl.
*B67B 7/44* (2006.01)

(52) U.S. Cl. ..... 81/3.15; 81/3.09

(58) Field of Classification Search ..... 81/3.09, 81/3.15, 3.55, 3.07, 3.25; 7/151; D8/33, D8/38

See application file for complete search history.

(56) References Cited

U.S. PATENT DOCUMENTS 1,755,086 A * 4/1930 Tapp ..... 81/3.09
2,510,459 A * 6/1950 Bloomfield et al. ..... 81/3.55
3,055,541 A * 9/1962 Bonkowski ..... 206/198
4,760,763 A * 8/1988 Trick et al. ..... 81/3.09
D308,929 S 7/1990 Greig et al.
D320,560 S 10/1991 Allen
D367,413 S 2/1996 Ballin
D375,869 S 11/1996 Canela
D388,660 S 1/1998 Gruendl
5,799,551 A * 9/1998 Vitrac ..... 81/3.09
6,550,271 B2 * 4/2003 Silbert ..... 62/457.4
7,343,834 B2 * 3/2008 Howlett et al. ..... 81/3.09
7,404,345 B1 * 7/2008 Dipprey ..... 81/3.09
D601,862 S * 10/2009 Welch ..... D7/624.2
2007/0012140 A1 * 1/2007 Howlett et al. ..... 81/3.09
2008/0060479 A1 * 3/2008 Nelson ..... 81/3.09
2008/0141697 A1 * 6/2008 Coleman ..... 62/318
2008/0173135 A1 7/2008 Beard

* cited by examiner

*Primary Examiner* — David B Thomas
(74) *Attorney, Agent, or Firm* — Patricia M. Mathers

(57) ABSTRACT

An insulated container for holding a beverage container, such as a bottle or a can, is disclosed. An insulation liner is provided in the container. The insulated container incorporates a bottle opener into the sidewall of the container. The bottle opener has a lip and a leverage surface. A magnet is provided on the leverage surface, to hold the cap after it has been removed from the bottle.

13 Claims, 3 Drawing Sheets

INSULATED CONTAINER WITH BOTTLE OPENER

BACKGROUND INFORMATION

1. Field of the Invention

The invention relates to insulated containers for holding beverage containers, such as bottles and cans. More particularly, the invention relates to an insulated container that includes a bottle opener.

2. Description of the Prior Art

Insulated containers for holding bottles and/or cans of beer and soda are known. Today, microbrewery beers in bottles enjoy wide popularity. The disadvantage of such bottles is that the cap is typically not a twist-off crown cap, but a traditional cap that requires the use of a bottle opener to pry it off.

When enjoying such drinks, particularly in an outdoor location, it is often the case that a bottle opener is not available, because, for example, it was overlooked when packing the picnic goods or it was misplaced and can't be found.

What is needed therefore is an insulated container for beverage containers that itself contains a bottle opener.

BRIEF SUMMARY OF THE INVENTION

The invention is an insulated cup having a bottle opener incorporated into an outside wall of the container. The cup is fitted with an insulating liner to help maintain the temperature of the beverage that is held in the insulated cup. The bottle opener may be mounted onto or integrally formed with the wall of the container The bottle opener has a lip for engaging the edge of the bottle cap and a surface that serves as a leverage surface against the top of the bottle cap during the process of lifting the cap from the bottle. As used herein, the term "leverage surface" relates to that surface on the bottle opener that exerts the necessary counterforce on the bottle cap in order to pry the cap from the bottle. The leverage surface may be simply a portion of the wall of the container, or a reinforced surface. The user simply manipulates the position of the container, so that the edge of the bottle cap is fitted into the recess formed by the lip and the wall of the bottle opener, with the crimped edge of the cap up against the lip, and tilts the container, so that a portion of the cap is forced against the leverage surface, while at the same time, the lip is forced against the crimped edge of the bottle cap. The lip forces the crimped edge to uncrimp, which effectively releases the cap from the bottle opening.

A magnet for retaining the bottle cap, once it is removed, may also be provided on the leverage surface, thereby preventing the cap from dropping to the ground when it is lifted off the bottle.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 3:
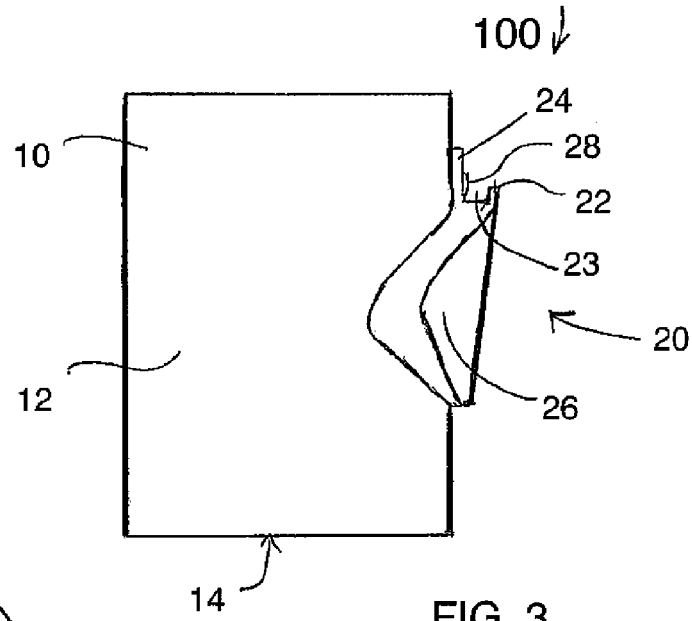
FIG. 3 is a side elevational view of the container of FIG. 1, showing a magnet on the leverage surface of the bottle opener.
Figure 2:
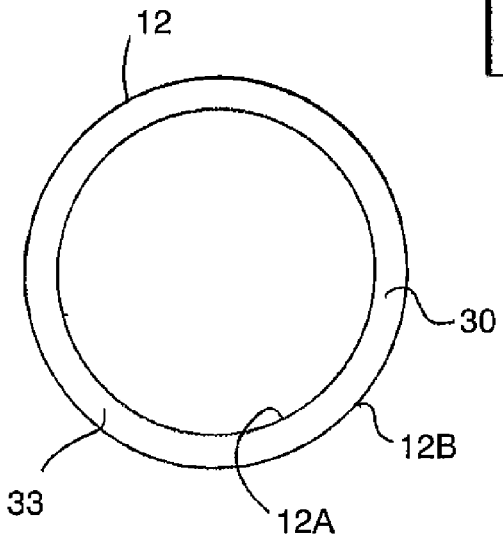
FIG. 2 is a top plan view of the container of FIG. 1.
Figure 1:
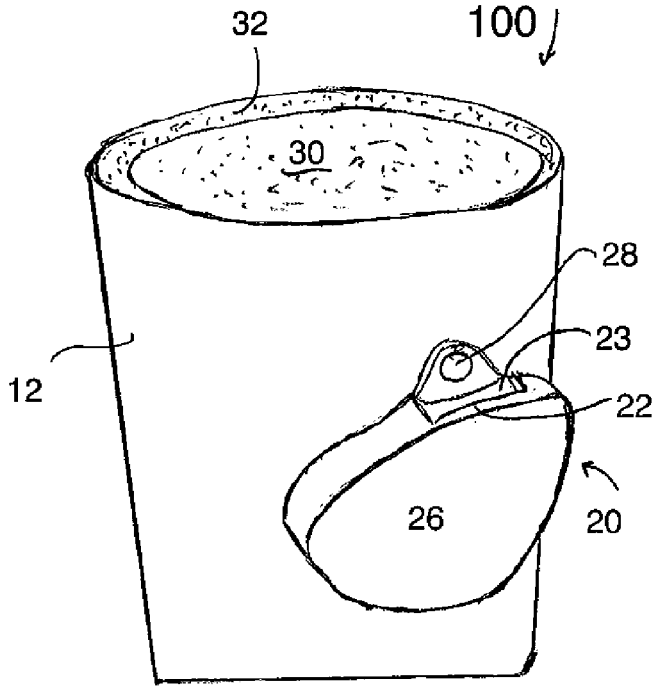
FIG. 1 is a perspective view of an insulated beverage container according to the invention, showing a bottle opener component attached to the outside wall of the container.

FIGS. 1-5 illustrate a first embodiment of an insulated beverage container with bottle opener 100 which comprises a cup 10, a bottle opener 20, and insulation 30. The insulation 30 in this embodiment is an insert that is constructed of a material that is different than that of the cup 10, for example, is a foam insert and is indicated by a dotted or mottled look. The cup 10 has a sidewall 12 and a bottom wall 14. In this particular embodiment, the bottle opener 20 is affixed to the sidewall 12. FIG. 2 is a detailed drawing of the bottle opener 20, which includes bottle opener body 26, a bottle opener lip 22, and a leverage surface 24. The size and shape of the bottle opener body 26 may vary widely, depending on aesthetics and the general shape of the cup 10. In the embodiment shown, the body 26 is a raised body that protrudes outward from the surface of the cup 10 and is of a size and shape that will readily accommodate a display surface 26A for displaying an insignia or logo. Incorporated into the leverage surface 24 is a magnet 28 for magnetically attracting a bottle cap C after it has been released from a bottle B.

Figure 4:
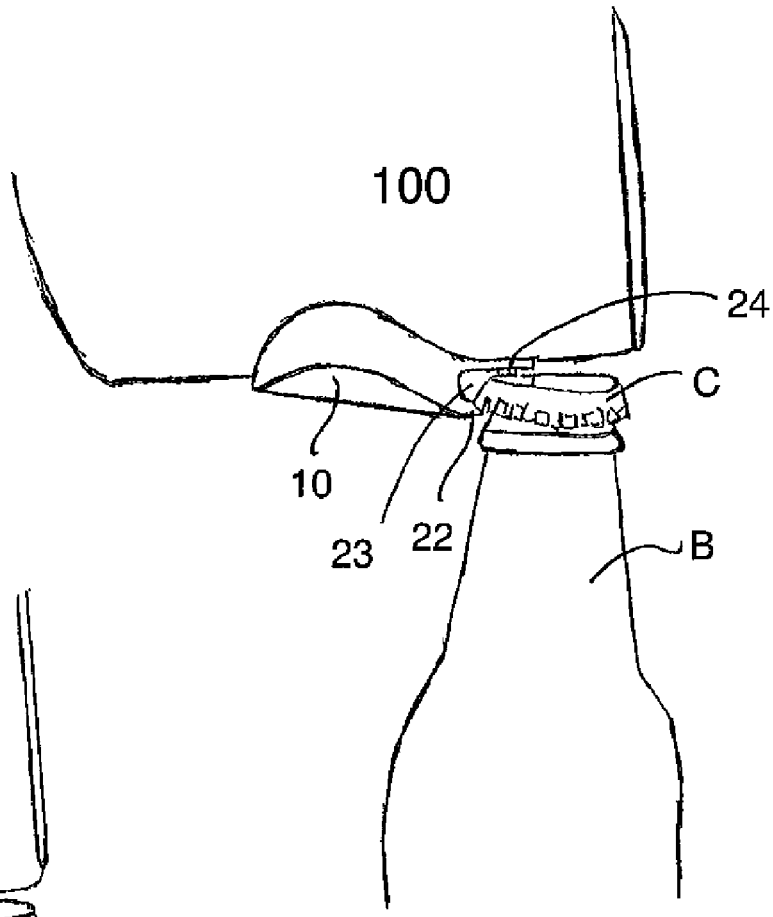
FIG. 4 illustrates a bottle cap being inserted into the recess of the bottle opener.
Figure 5:
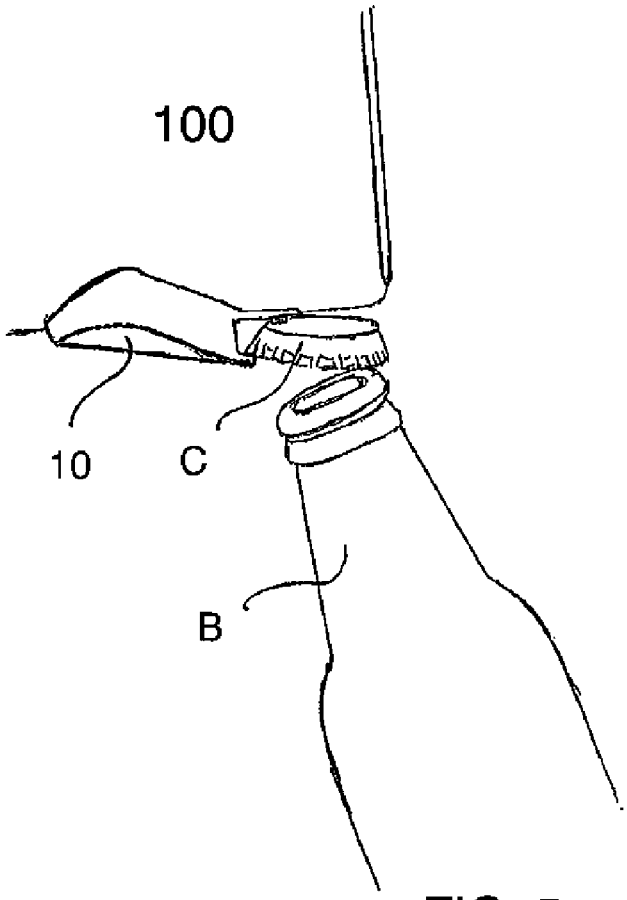
FIG. 5 illustrates the bottle cap being held by the magnet on the bottle opener after the cap has been removed from the bottle.

FIGS. 4 and 5 show the bottle cap C being pried from the bottle B. The cap is a conventional crown cork cap, with a crimped edge that provides a seal against the lip of the bottle. The leverage surface 24 and the bottle opener lip 22 form a recess 23. The container 100 is manipulated to bring the crimped edge of the cap C within the recess 23, with the crimped edge up against the bottle opener lip 22. The container 100 is then tilted, so that the bottle opener lip 22 exerts a lifting force against the crimped edge and the leverage surface 24 exerts a counteracting leverage force against the top of the bottle cap C. The lip 22 pulls several crimps on the edge open, thereby breaking the seal of the cap C on the bottle B. The bottle B is removed from the opener 20 and the cap C is held by the magnet 28 until it is intentionally removed.

FIG. 2 is a schematic illustration of the insulation 30 in the cup, which, in this embodiment, is an insert or liner 32. The liner 32 is preferably of compressible foam, as a compressible foam liner is able to accommodate various conventional sizes of beverage bottles and cans. It is also within the scope of the invention to provide the insulation 30 in different suitable embodiments. For example, the container 100 may be a double-walled plastic container with an inner wall 12A and an outer wall 12B, with a dead air space 33 between the two walls then serving as the insulation 30. It is also within the scope of the invention to provide the insulation 30 in the form of an insulative pack 36 that fits within the cup 10. Such coolant packs, also referred to as "gel packs" are typically sealed plastic fabric packages filled with a gel substance that retains cold or heat. The insulative pack 36 may be cooled in a refrigerator or freezer and inserted into the cup 10 as desired, or may also be heated in a microwave, if the desire is to prevent a beverage from freezing in very cold climates or to keep a beverage warm.

The cup 10 may be made of a metal, with the bottle opener 20 affixed to the sidewall 12 by adhesive or other type of bonding, or may be made of a synthetic material, with the bottle opener 20 integrally formed in the sidewall 12 or adhesively affixed. In the case of a non-metal bottle opener 20, the opener lip 22 may be reinforced with a metal blade 22A.

Figure 7:
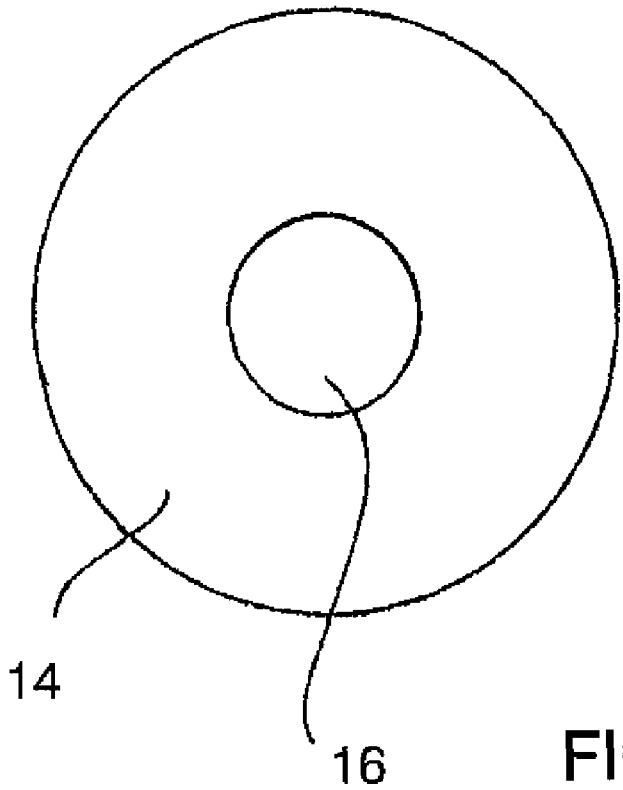
FIG. 7 illustrates an opening in the bottom surface of the cup.

FIG. 7 is a plane view of the bottom surface of the cup 10. Condensation typically forms on solids that are colder than the dew point of the ambient air. It may be desirable to provide the cup 10 with an opening 16 in the bottom of the cup 10, to allow condensation water to drain from the container. The opening 16 may also serve as an opening that will allow the user of the insulated cup with bottle opener 100 to push the beverage container upward, for the purpose of removing it. This may be particularly desirable when the beverage container is a can, the typical beverage can being shorter than the typical beverage bottle, so pushing against the bottom of the can may facilitate removing it from the insulated cup 100.

The display surface 26A on the bottle opener 20 may be printed or embossed with an insignia or logo, for marketing purposes.

Figure 6:
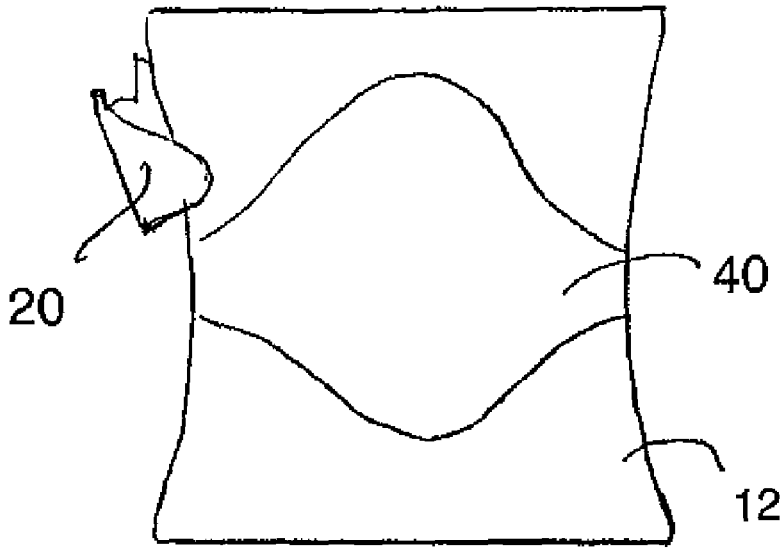
FIG. 6 is a side elevational view of a second embodiment of the cup according to the invention, showing a slight hourglass shape and grip surfaces.

FIG. 6 illustrates the insulated cup with bottle opener 100, that has a slightly hourglass shape. It is understood, that the external shape of the insulated cup with bottle opener 100 is not limited to a particular size or shape. The shape of the cup 10 on the inside is preferably cylindrical, to accommodate the shape of the beverage bottle or can, but the outside shape and size of the cup 10 may be creatively constructed, depending on the particular aesthetic look and feel that is desired. A grip surface 40 may also be provided on the sidewall 12 of the cup 100, regardless of the shape of the cup. In the embodiment shown, the bottle opener 20 is closer to the upper edge of the cup 100 and the grip surface 40 encircles the circumference of the cup 100. The grip surface 40 may be made of hard rubber, silicone, or any other suitable material, and adhesively or otherwise bonded to the sidewall 12. It is understood, that the particular shape of the grip surface 40 may vary and is not limited to the shape shown in the illustration.

It is understood that the embodiments described herein are merely illustrative of the present invention. Variations in the construction of the insulated beverage container with bottle opener may be contemplated by one skilled in the art without limiting the intended scope of the invention herein disclosed and as defined by the following claims.

What is claimed is:

1. A container with bottle opener comprising:

a cup having a sidewall and a bottom wall, the sidewall forming an inner recess for receiving a beverage container;

and a bottle opener that is provided on the sidewall, the bottle opener being a raised body having a perimeter that extends away from the sidewall, a portion of the perimeter of the body having an opener lip and a leverage surface with a recess formed therebetween.

2. The container of claim 1, wherein the bottle opener is affixedly mounted on the sidewall.

3. The container of claim 1, wherein the cup is a molded construction and the bottle opener is integrated into the molded construction.

4. The container of claim 3, wherein a metal reinforcement is provided on the opener lip.

5. The container of claim 1, wherein a magnet is provided on the leverage surface, so as to attract a bottle cap when the cap is pried from a bottle.

6. The container of claim 1, wherein the sidewall of the cup has an outer shape that is slightly curved in an hourglass shape.

7. The container of claim 1, wherein a grip surface is provided on the sidewall.

8. The container of claim 7, wherein the grip surface is a hard rubber material that is affixed to the sidewall.

9. The container of claim 1, wherein an through-hole is provided in the bottom wall of the cup.

10. The container of claim 1, further comprising an insulating means provided within the cup.

11. The container of claim 10, wherein the insulating means is a foam liner.

12. The container of claim 10, wherein the cup is a double-walled construction and the sidewall includes an inner wall and an outer wall, and wherein the insulating means is a dead air space between the two walls.

13. The container of claim 10, wherein the insulating means is a coolant pack that is inserted into the cup.

* * * * *